US006132187A

United States Patent [19]

Ericson

[11] Patent Number: 6,132,187

[45] Date of Patent: Oct. 17, 2000

[54] FLEX-ACTUATED BISTABLE DOME PUMP

[76] Inventor: Paul Leonard Ericson, 3084 6th St., Boulder, Colo. 80304

[21] Appl. No.: 09/251,045

[22] Filed: Feb. 18, 1999

[51] Int. Cl.[7] ..... H05B 3/02

[52] U.S. Cl. ..... 417/486; 417/395; 417/413

[58] Field of Search ..... 417/472, 486, 417/389, 395, 413, 490, 477.2; 604/67, 153, 8, 9; 137/496; 202/207; 29/890.13; 307/119; 92/103 F; 310/331

[56] References Cited

U.S. PATENT DOCUMENTS

| | | | |
|---|---|---|---|
| 2,888,877 | 6/1959 | Shellman et al. . | |
| 3,733,149 | 5/1973 | Jacobson . | |
| 3,955,901 | 5/1976 | Hamilton . | |
| 4,111,616 | 9/1978 | Rankin | 417/472 |
| 4,158,530 | 6/1979 | Bernstein | 417/389 |
| 4,344,743 | 8/1982 | Bessman et al. . | |
| 4,718,893 | 1/1988 | Dorman et al. | 604/67 |
| 4,741,678 | 5/1988 | Nehring | 417/395 |
| 4,816,016 | 3/1989 | Schulte et al. | 604/9 |
| 4,936,758 | 6/1990 | Coble | 417/413 |
| 4,974,674 | 12/1990 | Wells . | |
| 4,995,864 | 2/1991 | Bartholomew et al. | 604/153 |
| 5,036,879 | 8/1991 | Ponci | 137/496 |
| 5,197,192 | 3/1993 | Wylie et al. | 29/890.13 |
| 5,197,637 | 3/1993 | Naumann | 202/207 |
| 5,281,108 | 1/1994 | Brooke . | |
| 5,372,578 | 12/1994 | Kriesel et al. | 604/8 |
| 5,556,263 | 9/1996 | Jacobsen et al. | 417/490 |
| 5,563,458 | 10/1996 | Ericson | 307/119 |
| 5,575,632 | 11/1996 | Morris et al. | 417/477.2 |
| 5,743,170 | 4/1998 | Pascual et al. | 92/103 F |
| 5,889,354 | 3/1999 | Sager | 310/331 |

*Primary Examiner*—Teresa Walberg
*Assistant Examiner*—Leonid Fastovsky
*Attorney, Agent, or Firm*—Earl C. Hancock; Francis A. Sirr; Holland & Hart LLP

[57] ABSTRACT

A liquid/gas pump includes a stainless steel strip of uniform width that is encased within a flexible and liquid/gas impermeable plastic tube whose inner diameter is only somewhat less than the width of the metal strip. The tube is thus deformed to a generally elliptical shape, and the longitudinal edges of the metal strip are sealed by physical contact with the inner diameter of the plastic tube. Two elongated passageways are thus formed, one passageway being above the metal strip, and the other passageway being below the metal strip. A linear series of bistable position and somewhat overlapping shallow domes are formed into the metal strip. As one end of the plastic tube and metal strip assembly is reciprocated relative to the other end, the metal domes pop from one side of the metal strip to the other side. As a result, the volume of a first passageway increases as the volume of the other passageway decreases. As a result, liquid/gas is drawn into one end of the first passageway as liquid/gas is dispensed from one end of the other passageway. Each passageway includes a first check valve allowing liquid flow from the respective passageway. Each passageway includes a second check valve that allows liquid flow out of the passageway.

33 Claims, 4 Drawing Sheets

FLEX-ACTUATED BISTABLE DOME PUMP

BACKGROUND OF THE INVENTION

1. Field of the Invention

This invention relates to the field of pumps, and more specifically, to pumps wherein the pump is actuated by a reciprocating motion and in which flowable material is pumped without relative motion occurring between structural elements that are within the pump.

2. Description of the Related Art:

The art provides various showings of flexible tube and flexible diaphragm pumps. Representative are U.S. Pat. Nos. 2,888,877, 3,733,149, 3,955,901, 4,344,743, 4,974,674, and 5,281,108. While devices such as shown in these patents have been generally satisfactory for their limited intended purposes, the need remains in the art for a simple and reliable pump that includes a minimum number of parts and that operates by virtue of a simple oscillatory or reciprocating motion.

This invention makes use of one or more shallow bistable domes that are formed in a strip of a metal, such as hardened stainless steel. U.S. Pat. No. 5,563,458 by the present inventor, and entitled APPARATUS AND METHOD FOR SENSING SURFACE FLEXURE, is incorporated herein by reference. The apparatus/method of this patent makes use of a generally similar strip of metal in a flexible circuitry laminate to form a paper thin sensor of flexible on/off switches.

SUMMARY OF THE INVENTION

The flexible pump of this invention operates to pump a flowable material, such as liquid or gas, when an elongated, flexible, plastic or plasticlike tube is bent. The pumping mechanism within the tube comprises at least one, and preferably an elongated row of metal, stainless steel, or hardened stainless steel shallow bistable domes that invert or switch back and forth, between an inside curvature or concave state and an outside curvature or convex state, in response to reciprocating bending of the tube/strip pump assembly. Dome switching within the tube causes flowable material to be drawn into the tube as the dome(s) assumes a first state, and causes flowable material to be dispensed from the tube as the dome(s) assumes a second stable state. Flow in and flow out check valves are provided to control the direction of flow through the tube.

While spherically, generally spherical, or pseudo spherical shaped domes are preferred within the spirit and scope of this invention other dome shapes can be used.

While stainless a flexible metal plate and a flexible metal strip will be described in relation to embodiments of the invention, note is to be taken that within the spirit and scope of this invention other flexible materials, such as plastics, composites and laminates are usable in the practice of the invention.

The simple pump of this invention provides that no mechanical movement occurs between structural pump members. That is, pumping results from the movement of the bistable metal domes from one side of the metal strip to the other.

An object of this invention is to provide a pump having a housing that defines an interior volume. A flow in check valve allows flow into the interior volume. A flow out check valve allows flow out of the interior volume. A flexible metal plate having a center portion forms a wall of the interior volume, and edge portions of the metal plate extend exterior of the housing. At least one bistable dome is formed in the center portion of the plate metal member such that a direction of inward or outward protrusion of the bistable dome relative to the interior volume operates to switch back and forth relative to the interior volume as the plate edge portions are subjected to a bending force. Switching of the bistable dome in a concave direction operates to reduce the interior volume and produce pump pressure. Switching of the bistable dome in a convex direction operates to increase the interior volume and produce pump suction.

Another object of this invention is to provide a pump that includes an elongated flexible tube having a generally circular cross section and an inner diameter, and a thin, elongated, and flexible metal strip that has a relatively uniform width and generally parallel side edges, wherein the strip's width is greater than the tube's inner diameter. The metal strip is inserted into an end of the tube. The metal strip thereby operates to cause the tube to deform to a generally elliptical cross section, with the edges of the metal strip being physically sealed to the tube by physical engagement with the tube inner surface. In this way, a first elongated passageway is formed on one side of the metal strip, and a second elongated passageway is formed on an opposite side of the metal strip. The metal strip carries at least one bistable shallow metal dome that is formed in the metal strip, and preferably the metal strip carries a linear, elongated row of a number of the metal domes. When a row of domes is provided, the generally circular perimeter of adjacent domes preferably overlap. When the tube and strip are bent as a pump unit and in a direction generally normal to the metal strip, the direction of protrusion of the bistable dome(s) switch move from one of the passageways to the other passageway, depending upon the direction of bending. In this way, an increased volume of the one passageway operates to cause the one passageway to become a suction source, and a concomitant decrease in the volume of the other passageway causes the other passageway to become a pressure source.

The flow in and flow out check valves that are shown and described relative to the various embodiments of this invention can take many forms, and their detailed construction and arrangement is not critical to the invention. While these check valves are shown as being associated with portions of the pump assembly that are not related to the bistable dome(s) of the invention, if desired, the check valves can be incorporated within the flexible plate/strip that contains the bistable dome(s), or perhaps in some part of the bistable dome(s). These and other features and advantages of the invention will be apparent to those of skill in the art upon reference to the following detailed description, which description makes reference to the drawing.

DESCRIPTION OF THE PREFERRED EMBODIMENTS

This invention provides a flexible pump assembly that pumps a flowable material when the pump assembly, or a portion of the pump assembly, is bent. The pumping mechanism comprises one shallow bistable dome, or an overlapping row or linear array of bistable domes, that switch back and forth from one stable state of curvature, for example an inside curvature, to a second stable state of curvature, for example an outside curvature, in response to a bending force being applied to the pump assembly.

A preferred material for forming the bistable dome(s) is a metal such as stainless steel, hardened stainless steel, or any plastic, composite, laminate, or metal-like material having similar hard, flexible, characteristics.

The bistable dome(s) forms a wall of a housing having first and second check valves to control the direction of flow into and out of the housing. In this way, a closed housing is formed, the housing having an internal volume. When the dome(s) move to an outside curvature state, the internal volume of the housing is increased, and a suction force within the housing pulls a flowable material (for example, liquid or gas) into the internal volume, through a flow in check valve. When the dome(s) move to an inside curvature state, the internal volume of the housing is decreased, and a pressure force forces the flowable material out of the internal volume through a flow out check valve.

A proportional relationship exists between the degree of inside curvature/outside curvature and the quantity of flowable material that is pumped. All that is required for pumping to occur is that leverage, or force, be applied to effect displacement of the dome(s) between two stable curvature states. When the metal material adjacent to the dome is bent in the same direction as a first stable position or state currently occupied by the dome, flexural forces within the metal cause the dome to buckle, snap, move or invert in the other direction to the dome second stable state.

A wide variety of natural and mechanical force phenomenon can be used to provide the bending force that is necessary to actuate the pump, and the details of these force means are not critical to the invention. The simplicity of this invention dome and pump construction provides a high degree of versatility and economy for a wide range of dimensional scales and pumping applications.

Figure 1:
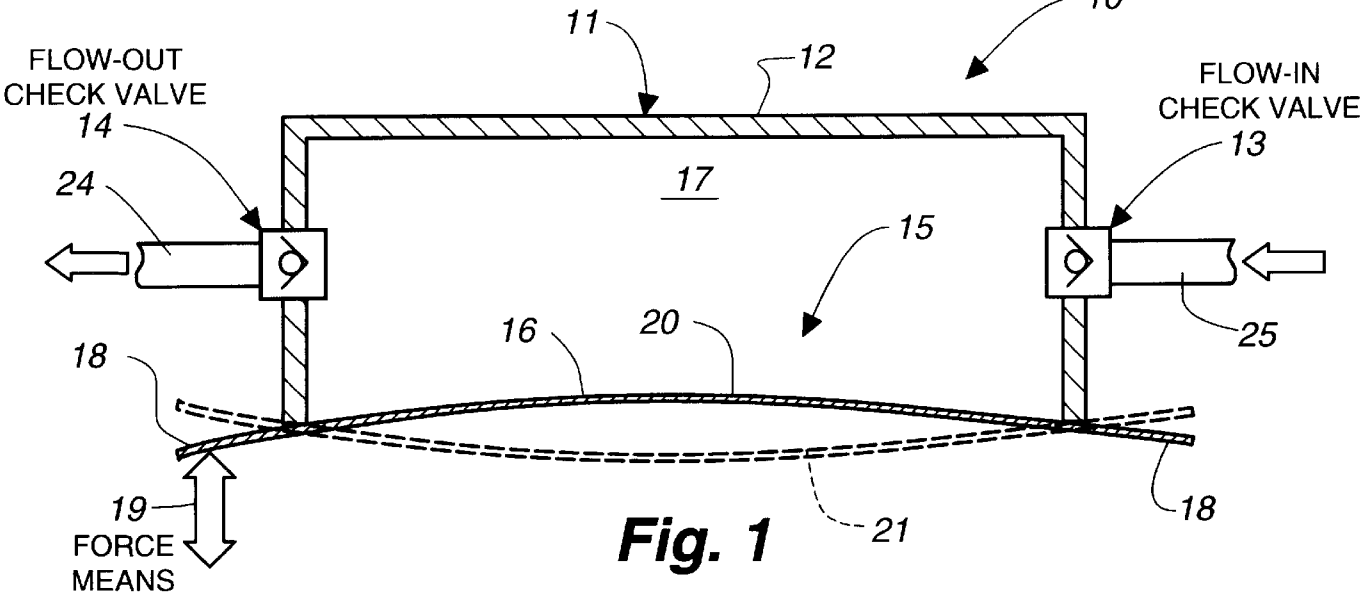
FIG. 1 is a side view, partially in section, of an embodiment of the invention where a closed housing includes a flow-in check valve, a flow-out check valve, and a generally square metal plate having one bistable dome formed therein.
Figure 2:
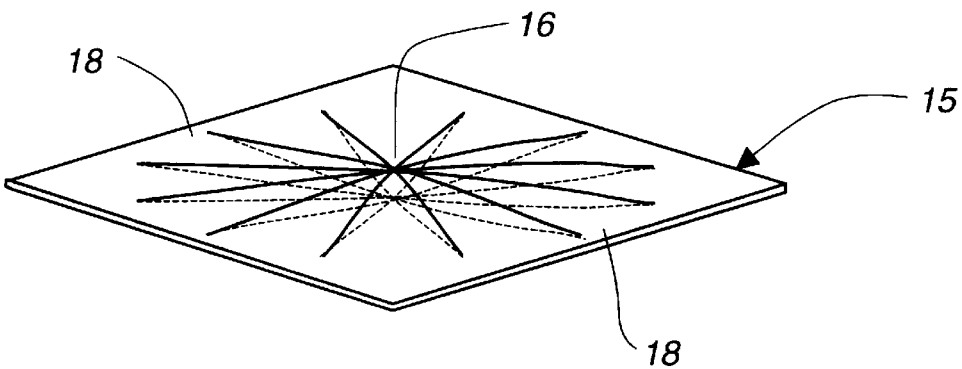
FIG. 2 is a reduced size perspective view of the metal plate of FIG. 1, this view better showing the shape of the plate bistable dome.

FIGS. 1 and 2 show a single dome embodiment of the invention. Pump 10 of this embodiment includes a closed housing 11 that is made up of a generally rigid box-like member 12 having an open bottom and side walls that include a flow in check valve 13 and a flow out check valve 14. The generally square bottom opening of box-like member 12 is closed by a generally square metal plate 15 having one bistable dome 16 formed generally in the center thereof as best seen in FIG. 2. The means of attaching metal plate 15 to box-like housing is not critical to the invention, with the exception that the attachment means should not excessively inhibit bending of metal plate 15 by operation of reciprocating force means 19, as will be described. While closed housing 11 is shown as being generally cubical in shape with its bottom opening closed by metal plate 15 the spirit and scope of the invention is not to be limited to this cubical construction and arrangement, nor to this bottom placement of metal plate 15.

Closed housing 11 defines a generally cubical interior volume 17. One or more peripheral edges 18 of plate 15 remain exposed outside of volume 17. Any of a great number of force means 19, not critical to this invention, are associated with one or more peripheral edges 18 of metal plate 15. Force means 19 operates to apply an oscillatory bending force 19 to the generally flat plane of plate 15, best seen in FIG. 2.

Figure 4:
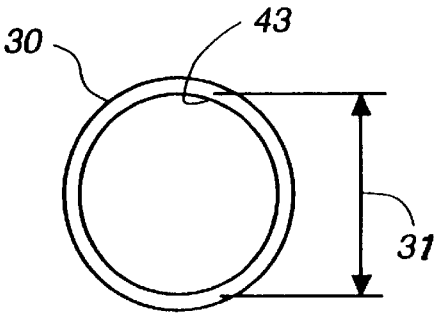
FIG. 4 is an end view of the tube shown in FIG. 3.
Figure 5:
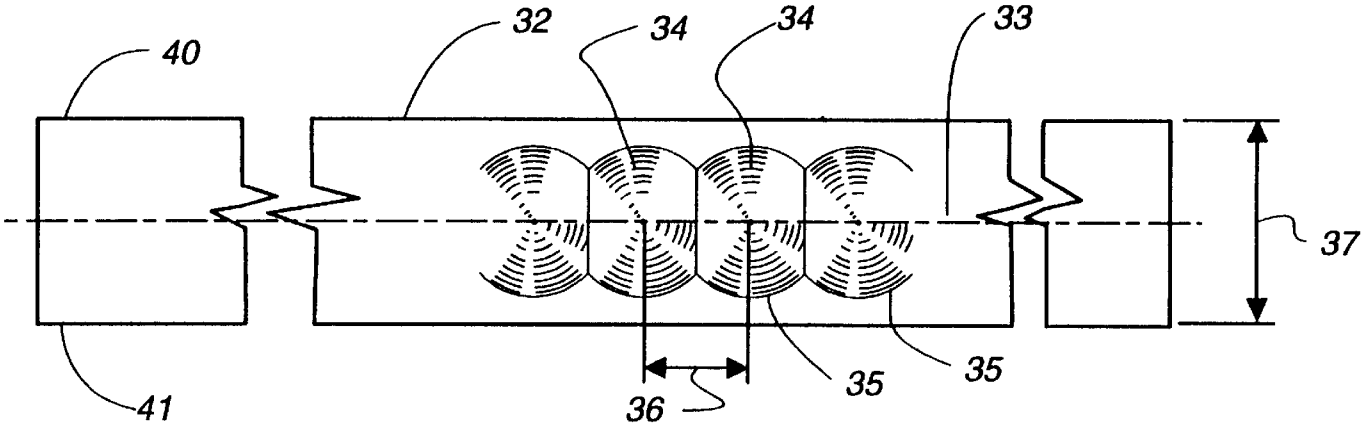
FIG. 5 is a top view of a metal strip having a linear row or array of overlapping metal domes for use in the second embodiment of the invention.

As a result of the operation of oscillating force means 19, bistable dome 16 is caused to oscillate between a stable concave state 20, and a stable convex state 21. When bistable dome 16 moves to its stable concave state 20, interior volume 17 is reduced, pump pressure is produced, and flowable material within interior volume 17 flows out of flow out check valve 14, into conduit 24, and thereby into a flow in source (not shown). When bistable dome 16 moves to its stable convex state 21, interior volume 17 is increased, pump suction is produced, and flowable material held by a flow in source (not shown) flows into conduit 25, into flow in check valve 13, and into interior volume 17. FIGS. 3–6 show an embodiment of the invention wherein a pump is made up of a longitudinally flexible tube 30 that tightly holds, or confines, a longitudinally flexible metal strip 32 in which a row of bistable domes 34 are formed, the domes preferably being dimensionally overlapping domes as best seen in FIG. 5.

Figure 3:
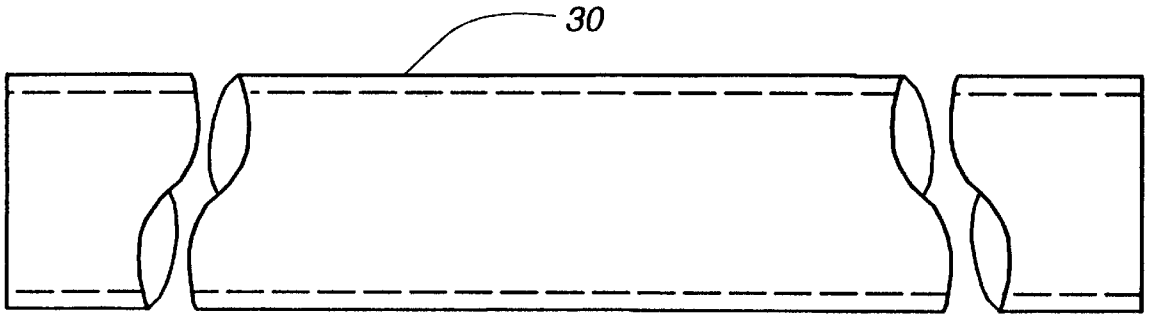
FIG. 3 is a side view of a flexible tube that is used in a second embodiment of the invention.

FIG. 3 is a side view of the flexible tube 30 that is used in this second embodiment of the invention (preferably a plastic tube). FIG. 4 is an end view of tube 30 showing its inner diameter 31. FIG. 5 is a top view of a thin metal strip 32 (preferably stainless steel) having a linear row or array 33 of metal domes 34 formed therein. Each of the domes 34 define a peripheral edge 35 that lies in the generally flat plane of metal strip 32. As shown in FIG. 5, domes 34 preferably have a center-to-center spacing 36 such that the peripheral edges 35 of adjacent domes dimensionally overlap.

Figure 6:
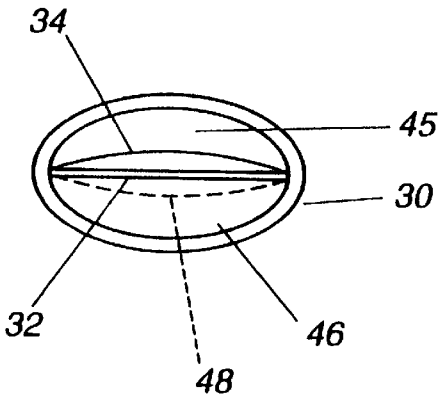
FIG. 6 is an end view of the second embodiment of the invention wherein the metal strip of FIG. 5 has been inserted into one end of the FIG. 3 flexible tube, thus causing the tube to take a generally elliptical shape as the edges of the metal strip are sealed to the interior surface of the tube, such that bending the tube in a direction generally normal to the plane of the metal strip operates to bend the metal strip and cause the metal domes to move between their two stable concave/convex states.

In this embodiment, the width 37 of flexible metal strip 32 is somewhat greater than the inner diameter 31 of flexible tube 30. FIG. 6 is an end view showing how flexible metal strip 32 is inserted into one end of flexible tube 30, thus forcing the cross section of tube 30 to take a generally elliptical shape as the two edges 40 and 41 of the metal strip 32 are sealed to the interior surface 43 of tube 30. It is to be noted that while metal strip 32 is longitudinally flexible in a direction generally normal to its flat plane, metal strip 32 is relatively stiff in its width dimension 37. Thus, metal strip 32 operates to maintain the elliptical cross section of tube 30 shown in FIG. 6 throughout the operation of the pump.

As best seen in FIG. 6, metal strip 32 operates to divide the interior volume of tube 30 into an upper interior volume 45, and a lower interior volume 46. In FIG. 6, the various bistable domes 34 within metal strip 32 are shown to be in their upward stable position. In this position, the interior volume 45 has been reduced, and interior volume 46 has been increased. When bistable domes 34 assume their lower stable position, shown by dotted line 48, interior volume 45 has been increased and interior volume 46 has been decreased.

Figure 7:
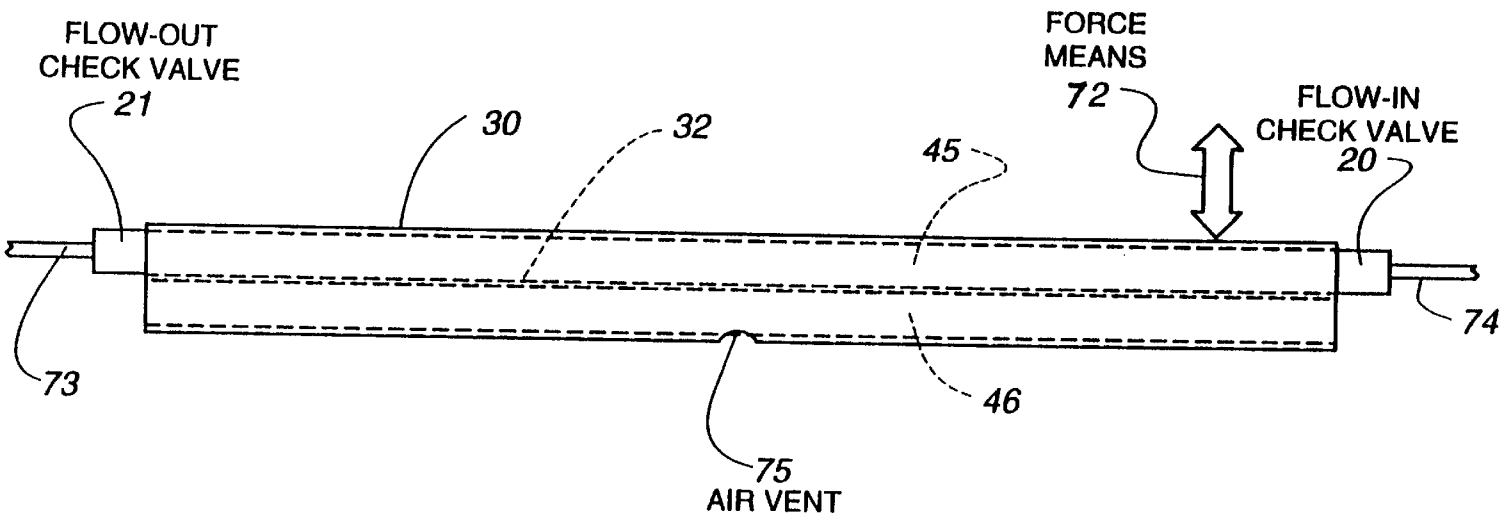
FIG. 7 is a side view of an embodiment of the invention wherein the pump assembly of FIG. 6 includes one pumping chamber and two flow control check valves.
Figure 8:
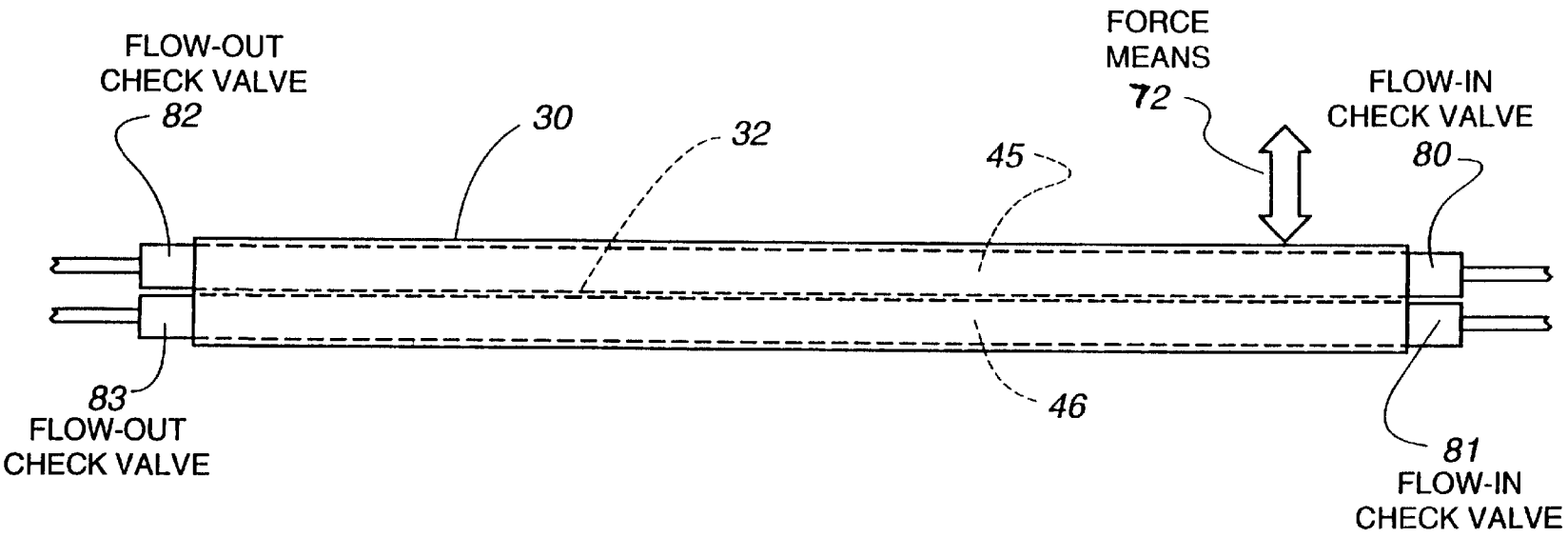
FIG. 8 is a side view of an embodiment of the invention wherein the pump assembly of FIG. 6 includes two pumping chambers and four flow control check valves, a flow in and a flow out check valve being provided for each of the two pumping chambers.

FIGS. 7 and 8 show two embodiments of the invention using the flexible tube/flexible strip pump assembly shown in FIG. 6.

FIG. 7 is a side view of an embodiment wherein the pump assembly of FIG. 6 includes one pumping chamber 45, a flow in check valve 70, and a flow out check valve 71.

The manner in which the pump assembly of FIG. 6 is bent, or oscillated in a direction generally normal to the plane of metal strip 32 (i.e., in a direction into and out of the plane of FIG. 5), is an oscillatory force means 72 that is applied to one end of the pump assembly in relation to the other end of the pump assembly, this other end of the pump assembly perhaps being a fixed position end.

As will be appreciated from the above description, when bistable domes 34 move to an upward position relative to the pump orientation that is shown in FIG. 7, the volume of pumping chamber 45 is decreased, a pump pressure is produced in pumping chamber 45, and flowable material in pumping chamber 45 flows out of flow out check valve 71, through conduit 73, and into a flow in source (not shown).

Alternately, when bistable domes 34 move to a downward position relative to the pump orientation that is shown in FIG. 7, the volume of pumping chamber 45 is increased, a pump suction is produced in pumping chamber 45, and flowable material from a flow in source (not shown) flows through conduit 74, through flow in check valve 70, and into pumping chamber 45. If desired, an air vent 75 may be provided in the FIG. 7 embodiment to vent chamber 46 above described relative to FIG. 6.

FIG. 8 is a side view of an embodiment of the invention that is generally similar to above-described FIG. 7. However, in FIG. 8, the two chambers 45 and 46 are each used as a pumping chamber, and each pumping chamber includes a flow in check valve 80, 81 and a flow out check valve 82, 83. While the check valves of FIG. 8 are arranged so that flow occurs in the same right to left direction through pumping chambers 46 and 46, it is within the spirit and scope of the invention to arrange the check valves to produce counter flow through the two pumping chambers.

Also as will be apparent from the above description of the operation of the pump assembly of FIG. 7, when the bistable domes 34 within metal strip 32 operate to produce pump suction in one of the two pumping chambers 45, 46, the bistable domes concomitantly operate to produce pump pressure in the other two pumping chambers 45, 46.

Without limitation thereto, a pump embodiment in accordance with this invention, comprises a linear row, or array, of fifty overlapping bistable domes 34, the fifty domes occupying a total band length of about 35 cm, wherein domes 34 were formed in a band or strip 32 of hardened stainless steel. Band 32 was about 12 mm wide (i.e., dimension 37 of FIG. 5) and about 0.152 mm thick (i.e., as measured normal to dimension 37).

Domes 34 were formed by stamping metal band 32 in a direction generally normal to the plane of the band (i.e., normal to the plane of FIG. 5), and between a convex tool (not shown) and a relatively movable concave die (not shown) whose contact surfaces approximated a spherical or pseudo-spherical shape. Dome bistability was best achieved by stamping both sides of band 32 for each of the domes 34. This metal stamping was performed so that domes 34 were about 10 mm in diameter, and had center to center spacing 36 of about 7 mm, thus providing an overlap of adjacent dome profiles, as shown in FIG. 5.

Metal band 32, containing the row 33 of bistable domes 34, was then inserted into a flexible polyvinyl chloride tube, or tubing 30, having an inner diameter (ID) 31 of about 8 mm, and an outer diameter (OD) of about 12 mm. During band insertion, tube 30 was temporarily flattened to provide for the ease of band insertion. A watertight/airtight seal was thus produced between the longitudinal edges 40, 41 of band 32, and the inner surface 43 of tube 30.

The tube/band bending device (i.e., the force means 72 of FIGS. 7 and 8) consisted of a motor-driven rigid arm that relatively moved the two opposite ends of the tube/band pump assembly. As a result, the middle of band 32 alternated between a convex and a concave curvature, and domes 34 experienced about a 0.17 mm dome displacement or popping distance.

The above-described flow in and flow out check valves consisted of short lengths of rubber tubing having thin rubber flaps that moved to uncover the tube central opening when pressure was applied to lift or pivot the flaps.

Pump assemblies in accordance with the invention operate in either a horizontal or a vertical orientation of the pump assembly, and the pump assembly does not require priming. An interesting utility of such a pump in accordance with this invention is to horizontally float the pump on a water surface, with waves in the water operating to flex the pump assembly and thereby produce a pumping action.

The invention has been described in detail while making reference to various embodiments. However, it is recognized that those skilled in the art will, upon learning of this invention, readily visualize yet other embodiments that are within the spirit and scope of this invention. Thus, the above-detailed description is not to be taken as a limitation on the spirit and scope of this invention.

What is claimed is:

1. A pump comprising:

a flexible tube having a generally circular cross section and an inner diameter;

a thin, elongated, and flexible strip having a relatively uniform width and having generally parallel side edges;

said strip width being greater than said inner diameter of said tube;

said strip being inserted within said tube, and said strip thereby operating to cause said tube to deform to a generally elliptical cross section, with said strip edges being generally sealed by engagement with said inner diameter of said tube;

said strip thereby forming a first chamber on one side of said strip;

said strip thereby forming a second chamber on an opposite side of said strip;

at least one bistable dome formed in said strip;

a direction of protrusion of said at least one bistable dome operating to switch back and forth between said first and second chambers as said tube and strip are subjected to alternate bending, as a unit, in one direction generally normal to said strip and then in an opposite direction generally normal to said strip; and said switching of said at least one bistable dome in one of said directions operating to reduce a volume of one of said chambers as a volume of the other of said chambers is concomitantly increased.

2. The pump of claim 1 including:

a first check valve associated with said first chamber;

said first check valve being constructed and arranged to allow flow into said first chamber;

a second check valve associated with said first chamber to allow flow out of said first chamber.

3. The pump of claim 2 including:

a third check valve associated with said second chamber;

said third check valve being constructed and arranged to allow flow into said second chamber;

a fourth check valve associated with said second chamber; and said fourth check valve being constructed and arranged to allow flow out of said second chamber.

4. The pump of claim 3 wherein said strip is a metal strip.

5. The pump of claim 1 wherein an elongated row of bistable domes are formed along a length of said strip.

6. The pump of claim 5 wherein said each of said bistable domes has a generally a spherical shape and wherein said domes are spaced such that said spherical shapes overlap along said length of said strip.

7. The pump of claim 6 including:

a first check valve associated with said first chamber;

said first check valve being constructed and arranged to allow flow into said first chamber;

a second check valve associated with said first chamber; and said second check valve being constructed and arranged to allow flow out of said first chamber.

8. The pump of claim 7 including:

a third check valve associated with said second passageway;

said third check valve being constructed and arranged to allow flow into said second chamber;

a fourth check valve associated with said second chamber; and said fourth check valve being constructed and arranged to allow flow out of said second chamber.

9. The pump of claim 8 wherein said strip is a stainless steel strip.

10. The pump of claim 9 wherein said flexible tube is impervious to material to be pumped.

11. A pump comprising:

a housing having an interior volume;

a first check valve allowing flow into said interior volume;

a second check valve allowing flow out of said interior volume;

a flexible member, said flexible member having portion that forms a wall of said interior volume, said flexible member having edge portions that are not within said interior volume; and at least one bistable dome formed in said portion of said flexible member;

a direction of inward/outward protrusion of said at least one bistable dome relative to said interior volume operating to switch back and forth relative to said interior volume as said edge portions of said metal member are subjected to a bending force, said dome switching being in a concave direction generally normal to said metal member, and then in a convex direction generally normal to said metal member;

said switching of said at least one bistable dome in said concave direction operating to reduce said interior volume, and said switching of said at least one bistable dome in said convex direction operating to increase said interior volume.

12. The pump of claim 11 wherein said flexible member is metal.

13. The pump of claim 11 wherein said housing is selected from the group rigid housing and flexible housing.

14. The pump of claim 11 wherein said flexible member is stainless steel and wherein said housing is selected from the group rigid housing and flexible housing.

15. The pump of claim 11 wherein a linear array of bistable domes are formed in said flexible member, each of said bistable domes having a generally spherical shape, and said domes being spaced such that said spherical dome shapes overlap along said linear array of bistable domes.

16. The pump of claim 15 wherein said flexible member is stainless steel and wherein said housing is selected from the group rigid housing member and flexible housing member.

17. A pump comprising:

housing means defining an interior volume;

a flow in check valve associated with said housing means;

a flow out check valve associated with said housing means;

a flexible plate having a generally center portion that forms a wall of said housing means, said plate having other portions exterior of said housing means;

a bistable dome formed in said generally center portion of said flexible plate;

force means operable to apply an alternating bending force to said other portions of said flexible plate, thereby causing said bistable dome to move between a stable inward protrusion state and a stable outward protrusion state;

said stable inward protrusion state of said bistable dome operating to reduce said interior volume and produce pump pressure; and said stable outward protrusion state of said bistable dome operation to increase said interior volume and produce pump suction.

18. The pump of claim 17 wherein said flexible plate is a flexible metal plate.

19. A pump comprising:

an elongated flexible tube having a first and a second end;

an elongated flexible strip tightly contained within said tube;

said flexible strip defining a first elongated tube volume having a first and a second end;

said flexible strip defining a second elongated tube volume having a first and a second end;

an elongated row of bistable domes formed in said flexible strip;

force means operable to apply an alternating bending force to said tube in a direction generally normal to said flexible strip, thereby causing said bistable domes to move between stable inward protrusion states and stable outward protrusion states;

a first flow in check valve associated with said first tube volume;

a first flow out check valve associated with said first tube volume;

said stable inward protrusion state of said bistable domes operating to reduce said first tube volume and producing pump pressure; and said stable outward protrusion state of said bistable domes operation to increase said first tube volume and producing pump suction.

20. The pump of claim 19 wherein each of said bistable domes includes a dome perimeter, and wherein dome perimeters of adjacent bistable domes dimensionally overlap.

21. The pump of claim 20 wherein said flexible strip is made of a material selected from the group flexible metal, flexible stainless steel metal, flexible plastic, a flexible composite material, a flexible plastic/metal laminate and a flexible plastic composite material.

22. The pump of claim 19 wherein said stable inward protrusion state of said bistable domes operates to increase said second tube volume and produce pump suction, and wherein said stable outward protrusion state of said bistable domes operate to decrease said second tube volume and produce pump pressure, including:

a second flow in check valve associated with said second tube volume; and a second flow out check valve associated with said second tube volume.

23. The pump of claim 22 wherein each of said bistable domes include a dome perimeter, and wherein dome perimeters of adjacent bistable domes dimensionally overlap.

24. The pump of claim 23 wherein said flexible strip is a stainless steel flexible strip.

25. A method of making a pump assembly, comprising the steps of:

providing a pumping chamber having a flow in check valve and a flow out check valve;

providing a flexible member as a wall of said pumping chamber;

providing at least one bistable dome in said flexible member; and providing oscillatory force means to flex said flexible member in alternating manner, to thereby cause a position of said at least one bistable dome to alternate between stable inward position relative to said pumping chamber and a stable outward position relative to said pumping chamber.

26. The method of claim 25 including the step of:

providing said flexible member as a flexible metal member.

27. The method of claim 25 including the steps of:

providing said flexible member as a flexible stainless steel strip; and providing a row of bistable domes in said stainless steel strip.

28. The method of claim 27 wherein said bistable domes are center to center spaced such that adjacent bistable domes dimensionally overlap while maintaining said center to center spacing.

29. The method of claim 25 including the steps of:

providing said flexible member as a flexible strip that is formed from the material group metal material, plastic material, composite material and laminate material.

30. The method of claim 29 including the step of:

providing a row of bistable domes in said flexible strip.

31. The method of claim 30 wherein said bistable domes are center to center spaced such that adjacent bistable domes dimensionally overlap while maintaining said center to center spacing.

32. The method of claim 25 including the steps of:

providing a tool and die set having mating surfaces that define a generally spherical surface; and using said tool and die set to form said at least one bistable dome in said flexible member.

33. The method of claim 29 including the step of:

providing said flexible member as a flexible strip that is formed of a metal or metal like material; and using said tool and die set to form a row of bistable domes in said flexible strip.

* * * * *